US005450864A

United States Patent [19]

LaJoie et al.

[11] Patent Number: 5,450,864

[45] Date of Patent: Sep. 19, 1995

[54] ARTIFICIAL NAIL TIPS

[75] Inventors: Aldran H. LaJoie, Laguna Hills; James A. Nordstrom; Janet E. Bragulla, both of Cardiff, all of Calif.

[73] Assignees: Creative Nail Design System Incorporated, Carlsbad; Cosmar Corporation, Huntington Beach, both of Calif.

[21] Appl. No.: 203,634

[22] Filed: Feb. 28, 1994

[51] Int. Cl.[6] ..... A45D 31/00

[52] U.S. Cl. ..... 132/73; 132/285

[58] Field of Search ..... 132/73, 285

[56] References Cited

U.S. PATENT DOCUMENTS

| | | | |
|---|---|---|---|
| D. 278,939 | 5/1985 | Hokama . | |
| D. 292,624 | 11/1987 | Otake . | |
| D. 295,451 | 4/1988 | Mast . | |
| D. 303,161 | 8/1989 | Tomkins . | |
| 1,942,332 | 1/1934 | Hamberg . | |
| 2,941,535 | 6/1960 | Lappe . | |
| 3,037,514 | 6/1962 | Lappe . | |
| 3,487,831 | 1/1970 | Jaume et al. . | |
| 3,552,401 | 1/1971 | Michaelson et al. . | |
| 3,750,684 | 8/1973 | Russell . | |
| 4,007,748 | 2/1977 | Matranga et al. . | |
| 4,106,614 | 8/1978 | Aylott | 132/73 |
| 4,135,526 | 1/1979 | Matranga et al. | 132/73 |
| 4,140,139 | 2/1979 | Aylott | 132/73 |
| 4,157,095 | 6/1979 | Sweet . | |
| 4,222,399 | 9/1980 | Ionescu . | |
| 4,346,720 | 8/1982 | Hokama | 132/73 |
| 4,407,310 | 10/1983 | Jadow . | |
| 4,408,622 | 10/1983 | Meyerhopfer et al. | 132/73 |
| 4,511,608 | 4/1985 | Ferraro . | |
| 4,554,935 | 11/1985 | Hokama . | |
| 4,559,055 | 12/1985 | Ogunro . | |
| 4,596,260 | 6/1986 | Giuliano . | |
| 4,600,030 | 7/1986 | Newman . | |
| 4,625,740 | 12/1986 | Roth . | |
| 4,627,453 | 12/1986 | Isler . | |
| 4,671,305 | 6/1987 | Mann | 132/73 |
| 4,690,369 | 9/1987 | Giuliano | 132/73 |
| 4,751,935 | 6/1988 | Mast et al. | 132/73 |
| 4,805,645 | 2/1989 | Schiff et al. | 132/73 |
| 4,876,121 | 10/1989 | Cohen . | |
| 4,898,192 | 2/1990 | Cohen . | |
| 4,920,991 | 5/1990 | Shibahashi et al. . | |
| 5,060,678 | 10/1991 | Baumann et al. . | |
| 5,070,892 | 12/1991 | Trematerra | 132/73 |
| 5,121,760 | 6/1992 | Ward | 132/73 |
| 5,127,414 | 7/1992 | Mast et al. . | |

*Primary Examiner*—Paul J. Hirsch
*Attorney, Agent, or Firm*—Lyon & Lyon

[57] ABSTRACT

The present application relates to artificial nail tips, particularly artificial nail tips which have an attachment area with an axial curvature and a cut-out portion which provide a comfortable and conforming fit to a variety of natural nails while maintaining structural integrity. The axial curvature of the attachment area of the nail tips is of a dual radius design which provides a more comfortable and conformable fit while helping to maintain the structural integrity of the nail tip. The cut-out portion of the nail tips is of a "V" shape which allows the nail tip attachment area to deform with less structural resistance while maintaining structural integrity. It is preferable that the V shaped cut out be at least slightly rounded at its apex to provide even greater structural integrity when the nail tip is deformed.

6 Claims, 2 Drawing Sheets

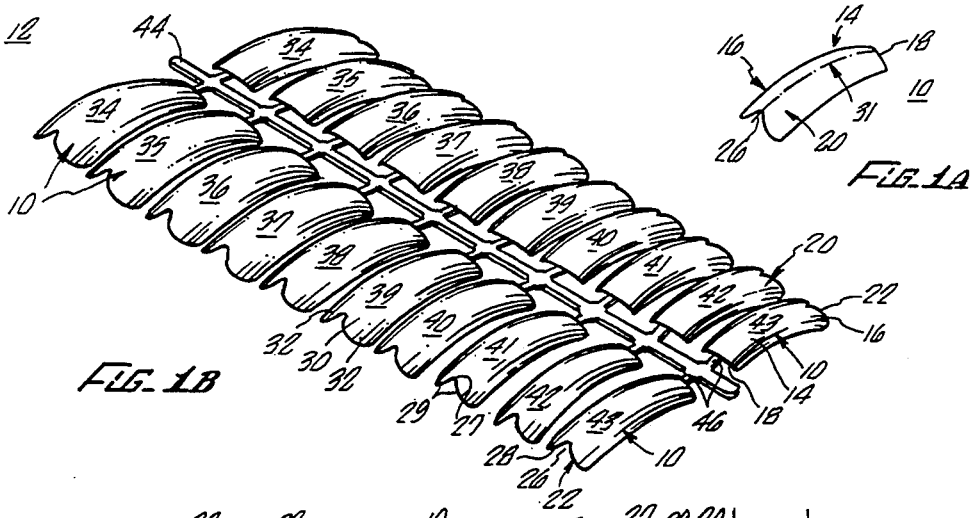
FIG. 1B
FIG. 1A
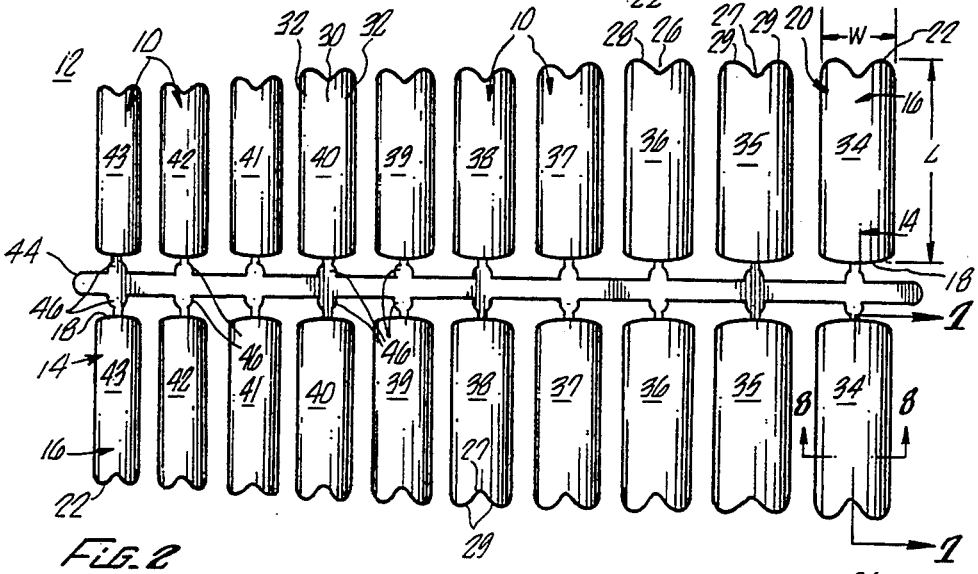
FIG. 2
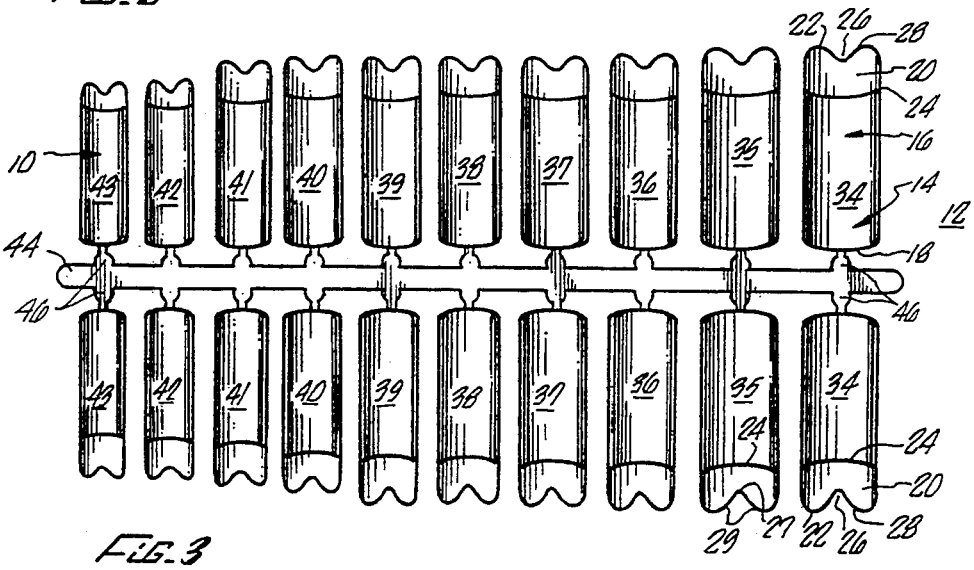
FIG. 3

ARTIFICIAL NAIL TIPS

FIELD OF INVENTION

The present invention relates to artificial nail tips, particularly artificial nail tips which have a fit which conforms to a variety of natural nails and which maintains structural integrity.

BACKGROUND

Artificial nail tips have been generally shown in the prior art for both cosmetic and prosthetic uses. However, prior nail tips suffer from problems of not properly conforming or fitting to natural nails. Prior nail tips suffer from the additional problem of not maintaining their structural integrity when they are forced to deform to fit a natural nail.

Prior nail tips are generally constructed in substantially rectangular shapes having a variety of lengths and widths wherein the length of a particular tip is typically several times the width. The nail tips may be cut and filed to form a particular desired shape. Prior nail tips are also provided with a particular thickness. In determining the thickness of the nail tip aesthetics, strength, and flexibility are often considered.

Nail tips are generally attached to a natural nail by overlaying and gluing a back or end portion of the nail tip onto a natural nail with the front or remaining portion of the nail tip overhanging the natural nail to form an extended nail tip. The extended nail tip which overhangs the natural nail may be cut and/or filed to a desired length and shape. Prior nail tips have been provided with an attachment or overlap end portion comprising an area of reduced thickness when compared to the other portions of the nail tip. The attachment end portion provides an area of increased flexibility which is overlaid upon and directly attached to a natural nail.

Prior nail tips also include a certain amount of curvature. Nail tips may be provided with a curvature along their length corresponding to a longitudinal curvature. The longitudinal curvature is defined by that curvature of the nail tip which exists along a line extending between the back end portion and the front end portion of the nail tip. Nail tips may be provided with a curvature along their width corresponding to an axial curvature. The axial curvature is defined by that curvature of the nail tip which exists around an axis extending the length of the nail tip (i.e. extending between the back end portion and the front end portion of the nail tip). Axial and, often times, longitudinal curvatures are provided for aesthetic and for attachment purposes.

Conventional nail tips generally incorporate an axial curvature having constant radius. However, such nail tips most often do not match the curvature of the natural nail to which the nail tip is to be attached. To attach such nail tips to a natural nail, the nail tips often must be deformed to the extent that the top of the nail tip experiences increased structural stress especially along a central portion of the top of the nail tip. In addition, the mismatch in curvatures also provides discomfort to the wearer of the nail tip and provides difficulty in attaching and fitting the nail tips by the applier. (Although the "wearer" and the "applier" are referred to here separately, the same person could be both the wearer and the applier of the nail tip.)

The wearer may experience discomfort when wearing such a nail tip due to the axial curvature of the nail tip squeezing or pinching the sides of the underlying natural nail. The applier of the nail tip may experience difficulty in attaching and fitting the nail tip to the wearer because of the uncertainty of the ability of the curvature of the nail tip to be deformed (e.g. flattened out) to properly fit the wearer's natural curvature without breaking, cracking or weakening, and because of the difficulty in filling a gap which is created between the nail tip and the underlying natural nail due to the curvature mismatch. The applier may experience additional difficulty in blending the nail tip to the natural nail to result in an aesthetically pleasing nail surface.

Nail tips of the prior art are generally formed of plastic, such as ABS plastic, tenite acetate, or nylon, which is molded into the shape of the nail tip. Such plastics generally are deformable to a certain extent. However, such plastics also maintain a memory of the curvature to which they were originally molded. A nail tip made of such plastic, therefore, exerts force to try to re-acquire its originally molded-in curvature. This force may provide the pinching effect described above. In addition, this force may make it difficult for an applier to determine the size of nail tip to be used on a wearer and to fit a nail tip to the wearer due to the difficulty in determining the extent the nail tip will deform to match the wearer's curvature. Furthermore, it is difficult for an applier to determine the extent to which the nail tip may be deformed without breaking, cracking or weakening (i.e. while maintaining its structural integrity). It is typical for prior tips to break, crack, or become weakened when deformed to a certain extent.

Prior nail tips have been shown which have attachment portions which include snap-out or cut-away areas. U.S. Pat. No. 4,805,645 to Schiff et al. shows a nail tip having a thinned attachment area with an even thinner perforated snap-out section therein. This patent asserts that the snap-out section is removable to permit increased flexibility of the attachment area and to permit a better attachment to a natural nail which has a "problem" or unusual shape or surface. The patent states that the better attachment is achieved because there is less attachment area contacting the "problem" or unusually shaped nail surface. However, snapping out the perforated area of the nail tip results in rough or uneven fragments which must be filed or cut to ensure a smooth and aesthetically pleasing nail surface. In addition, snapping out the perforated area may result in breaking or cracking the nail tip, or in weakening the structural stability of the nail tip. Furthermore, the nail tip described in this patent is shown in the figures of the patent as having a constant radius axial curvature and, therefore, suffers the problems associated with having such an axial curvature as described above (e.g. pinching).

U.S. Pat. No. 5,070,892 to Trematerra shows a nail tip having a thinned attachment area with a cut-away portion therein. The patent states that the cut-away area of this nail tip is in a symmetrical stair-step, sawtooth, or acute angle pattern which, the patent further states, permits the attachment area to be quickly and symmetrically trimmed by simply counting the number of steps or notches to be saved or removed. The patent also proclaims that the pattern of the cut-away area also provides an increased border area to be bonded to the underlying nail. The patent further reveals that the nail tip is said to be flexible due to the thinness of the attachment area and the shape of the cut-away portion. However, the jagged pattern of the cutaway section advocated by this patent does not maintain the structural stability of the nail tip when the attachment area is deformed or flexed to conform to the shape of an underlying natural nail, especially to natural nails which are flat or inconsistently shaped. In addition, the nail tip of this patent would require the application of additional overlay and bonding materials (e.g. require more blending or "feathering") to blend the jagged edges of the nail tip to the wearer's natural nail to result in an aesthetically pleasing nail surface. Furthermore, the nail tip shown and described in this patent is shown as having a constant radius axial curvature and, therefore, suffers all the problems associated with having such an axial curvature as described above (e.g. pinching).

A nail tip which has an axial curvature which is comfortable and flexible and which can be deformed while maintaining structural integrity and which is easily blended to the underlying natural nail to form an aesthetically pleasing nail surface is desirable.

SUMMARY OF THE INVENTION

The present invention provides a nail tip which has a "cut out" portion in a thinned attachment area to provide a flexible attachment area and, therefore, a more conforming fit of the nail tip to a variety of natural nails. The "cut out" portion is actually achieved by molding the nail tip to include such a portion, it is not achieved by actually cutting the nail tip. The cut out allows the nail tip attachment area to deform with less structural resistance (e.g. less resistance to the nail back expanding) to allow the nail tip to easily adapt to differently shaped natural nails without undue structural stress. The present nail tip also provides an axial curvature (i.e. curvature along the width of the nail tip) based on a dual radius design which enhances its comfort and conformability. In addition, the present invention provides this flexibility while maintaining structural integrity against breaks, cracks, and weakening.

It is a principal object of the present invention to provide an improved nail tip.

It is also an object of the present invention to provide an artificial nail tip which has a cut out portion providing a flexible and conforming fit to a variety of natural nails while maintaining structural integrity.

It is an additional object of the present invention to provide an artificial nail tip which has a thinned attachment portion which includes a cut out portion providing a flexible and conforming fit to a variety of natural nails while maintaining structural integrity.

It is a further object of the present invention to provide an artificial nail tip having a cut out portion in the shape of a "V" but preferably with a smoothly curved apex.

It is another object of the present invention to provide an artificial nail tip having a cut out portion close to the shape of a "V" which is at least slightly rounded at its apex.

It is yet another object of the present invention to provide an improved artificial nail tip having a dual radius axial curvature at least over the attachment area of the nail tip which enhances the comfort and conformability of the nail tip.

It is still another object of the present invention to provide an artificial nail tip having a cut out which reduces a casual observer's ability to distinguish between the nail tip and the underlying natural nail.

It is still a further object of the present invention to provide an artificial nail tip having a cut out which provides a more efficient blending of the nail tip to an underlying natural nail.

It is still an additional object of the present invention to provide an artificial nail tip having a cut out which allows for stronger boding between the nail tip and underlying natural nail when boding, for example, using an overlay, acrylic powder or other substance, or u.v. cured gel.

Other objects and features of the present invention will become apparent from consideration of the following description taken in conjunction with the accompanying drawings.

BRIEF DESCRIPTION OF THE DRAWINGS

FIG. 1A is a perspective view of an artificial nail tip of the present invention.

FIG. 1B is a perspective view of a set of artificial nail tips of the present invention.

FIG. 2 is a top plan view of the artificial nail tips of FIG. 1B.

FIG. 3 is a bottom plan view of the artificial nail tips of FIG. 1B.

DETAILED DESCRIPTION OF THE PREFERRED EMBODIMENT

The present invention provides artificial nail tips 10 which may be provided in a set 12 as seen in FIGS. 1A–1B. The present nail tips 10 are constructed in a generally rectangular shape having a length L which is larger than its width W. See FIGS. 2, 4, and 7. For example, the length L may be anything longer than 0.300 inches and the width W may be between 0.100 to 0.700 inches. Currently, the nail tips 10 are typically provided having lengths L between 0.500 to 1.50 inches and having widths W between 0.200 to 0.600 inches. However, the present nail tips 10 could be provided in any shape or size desired.

Figure 7:
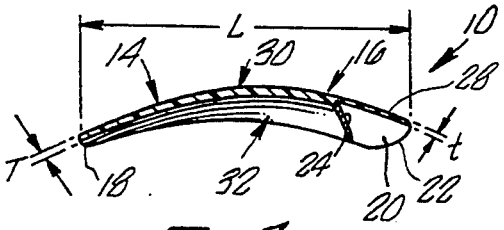
FIG. 7 is a cross-sectional view of an artificial nail tip of the present invention taken along line 7—7 of FIG. 2.

The generally rectangular shape of each nail tip 10 defines a front portion 14 (distal end) proximate to one end of the generally rectangular shape and a back portion 16 (proximal end) proximate to an opposite end of the generally rectangular shape. The front portion 14 ends in a front edge 18 of the nail tip 10 as seen in FIGS. 2, 3, and 7. The back portion 16 forms an attachment or overlap area 20 (the portion of the nail tip 10 which is attached to the wearer's natural nail) which ends in a back edge 22 as seen in FIGS. 3 and 7.

Each nail tip 10 has a general thickness T (FIG. 7) over most of its area which may taper depending on aesthetics or other factors. However, the attachment area 20 has a thickness t which is thinner than the thickness T to allow for greater flexibility of the attachment area 20 (FIG. 7). For example, thickness T is preferably in the range of 0.010 to 0.035 inches and thickness t is preferably in the range of 0.005 to 0.025 inches. Currently, the nail tips 10 are typically provided having thickness T of about 0.018 to 0.020 inches and thickness t of about 0.008 to 0.012 inches. A step 24 is formed where the thickness of the nail tip 10 transitions from thickness T to thickness t as shown in FIGS. 3 and 7.

The attachment area 20 of the nail tips 10 of the present invention includes a cut out section 26 forming a smooth almost "V" shaped edge 28 along the back edge 22 of the nail tip 10. The V shaped edge 28 preferably comprises a smooth curving edge such as seen in FIGS. 2 and 3. As shown in FIG. 3, the V shaped cut out 26 is positioned wherein the apex 27 of the V points toward the step 24 and the arms 29 of the V extend toward the back edge 22 of the nail tip 10. The V shaped cut out section 26 allows the attachment area 20 of the nail tips 10 to deform with less structural resistance while maintaining structural integrity. The apex 27 may be sharp like the apex of a "V" or may be smooth. It is preferable that the V shaped cut out section 26 be smooth or at least slightly rounded at its apex 27 to minimize cracking or breaking at the apex 27. A rounded apex 27 provide even greater structural integrity when the nail tip 10 is deformed because a sharp edge or angle is more likely to result in a crack or break.

The V shaped cut out section 26 has the added benefit of providing a stronger bond between the nail tip 10 and the underlying natural nail when the nail tip 10 is attached to the same through the use of overlays, acrylics, u.v. cured gels, or other adhesives. In addition, the cut out section 26 provides sufficient contact with an underlying natural nail to allow initial gluing of the nail tip 10 to the natural nail while exposing a relatively large area of the underlying natural nail to allow for a more efficient application of overlay and bonding materials (e.g. requiring less blending or "feathering" of the nail tip 10 to the underlying natural nail to form an aesthetically pleasing nail surface). Furthermore, the cut out section 26 provides a more natural looking nail tip 10 because the V shaped edge 28 between the nail tip 10 and the underlying natural nail reduces the a casual observer's ability to distinguish between the nail tip 10 and the underlying natural nail (i.e. reduces a "shadow" effect created by the overlap of an artificial nail tip on a natural nail).

Figure 4:
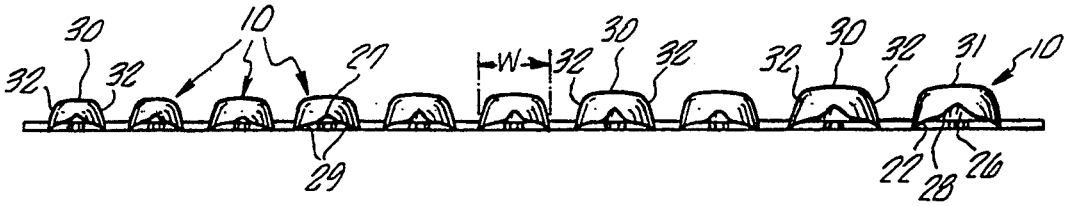
FIG. 4 is a front elevational view of the ends of the artificial nail tips of FIG. 1B (viewed from the right of FIG. 1B or from the top of FIG. 2), the rear view being a mirror image.
Figure 5:
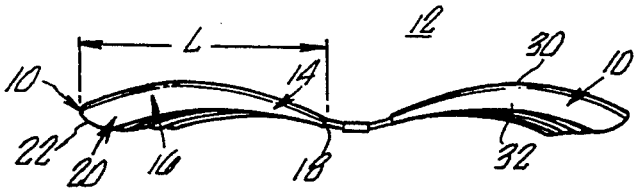
FIG. 5 is a side elevational view of the artificial nail tips of FIG. 1B (viewed from the right in FIG. 2).
Figure 6:
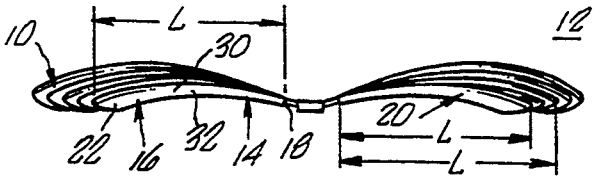
FIG. 6 is a side elevational view of the artificial nail tips of FIG. 1B (viewed from the left in FIG. 2), this view being of the side opposite that shown in FIG. 5.
Figure 8:
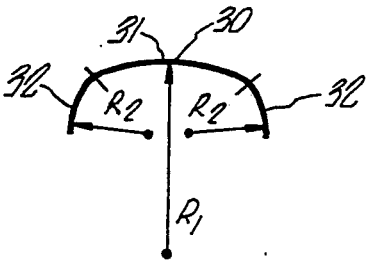
FIG. 8 is a cross-sectional view of an artificial nail tip of the present invention taken along line 8—8 of FIG. 2.

The present nail tips 10 may be provided with a variety of curvatures, such as a longitudinal curvature along the length L of the nail tips 10 as shown in FIGS. 5–7, to make the nail tips 10 appear aesthetically pleasing and more like a natural nail. As described above, the longitudinal curvature is defined by that curvature of the nail tip 10 which exists along a line extending between the back end portion 16 and the front end portion 14 of the nail tip 10. It is preferred that the nail tips 10 of the present invention be provided with an axial curvature along the width W of the nail tips 10 as shown in FIG. 4. As described above, the axial curvature is defined by that curvature of the nail tip 10 which exists around an imaginary axis extending along the length of the nail tip (i.e. around an axis extending at least somewhere between the back end portion 16 and the front end portion 14 of the nail tip 10). It is also preferred that the axial curvature of at least the attachment area 20 be defined by a combination to two radii $R_1$ and $R_2$ as shown in FIG. 8, wherein $R_1$ defines the curvature of the top 30 of the nail tip 10 and $R_2$ defines the curvature of both sides 32 of the nail tip 10 and, although $R_1$ and $R_2$ are different for each different size of nail tip 10, wherein $R_1$ is larger than $R_2$. Although the axial curvature is defined by a combination of two radii, it is not necessary (nor is it preferred) that the axial curvature be consistent over the entire nail tip 10. Rather, it is preferred, for a more natural looking nail tip, that the axial curvature flatten somewhat towards the front edge 18 as compared with the axial curvature at the back edge 22. It is preferred that at least the attachment area 20 have an axial curvature with a dual radius design.

This dual radius design of at least the attachment area 20 provides increased comfort to a wearer because it more closely matches the curvature of a typical natural nail and allows for easier deformation of the attachment area 20. In addition, the dual radius design provides a nail tip 10 with reduced structural stress at a central portion 31 of the top 30 of the nail tip 10 when the nail tip 10 is deformed to the shape of a natural nail which often is flat.

The artificial nail tips of the present invention are preferably made from tenite acetate, nylon or a blend of ABS plastics available from Dow and Monsanto. However, the present nail tips 10 are molded with the cut out section 26 and the dual radius curvature each of which reduce structural stress and the pinching effect described above.

FIGS. 1B, 2, and 3, show an exemplary set 12 comprising twenty variously sized nail tips 10 of the present invention. The nail tips 10 are gradually sized between a large nail tip 34 and a small nail tip 43 thereby providing a variety of sizes from which to choose. Sizing of nail tips 10 are typically determined by the amount of curvature, the width, and the length of the nail tips 10. The present nail tips 10 may be molded in a set 12 as shown in FIGS. 1B, 2, and 3, wherein differently sized nail tips 34–43 are molded to a detachable central stem 44 via stem branches 46. The set 12 shown in the figures comprises an exemplary set, variations in the number and sizes of nail tips 10 are contemplated.

While embodiments of the present invention have been shown and described, various modifications may be made without departing from the scope of the present invention, and all such modifications and equivalents are intended to be covered.

We claim:

1. An artificial nail tip comprising a body comprising a front portion and a back portion, the back portion including a thinned attachment area having a cut out section forming a smooth curving V shaped edge along a back edge of the back portion, and the V shaped edge having at least one arm which is rounded and extends toward the back edge of the back portion, and an apex which is rounded and extends toward the front portion.

2. An artificial nail tip comprising a body comprising a front portion and a back portion, the back portion including a thinned attachment area having a substantially V shaped cut out section having an apex extending toward the front portion, the thinned attachment area including a dual radius axial curvature, and the dual radius axial curvature having axes of curvature extending from the front portion to the back portion of the body.

3. The artificial nail tip of claim 2 wherein the thinned attachment area further comprises a top and two sides, and the dual radius axial curvature comprises the top of the attachment area following an axial curve having a radius of $R_1$ and the sides of the attachment area following an axial curve having a radius of $R_2$ wherein $R_1$ is larger than $R_2$.

4. An artificial nail tip comprising a body comprising a front portion and a back portion, the back portion including a thinned attachment area having a dual radius axial curvature along the width there of, and having a V shaped cut out section, and the V shaped cut out section having an apex which is rounded and which extends toward the front portion.

5. An artificial nail tip comprising a body comprising a front portion and a back portion, the back portion having a thinned attachment area including a cut out section and a dual radius axial curvature, the cutout section forming a smooth curving V shaped edge along a back edge of the back portion, the V shaped edge having at least one arm which is rounded and extends toward the back edge of the back portion and an apex which is rounded and extends toward the front portion, and the dual radius axial curvature having axes of curvature extending from the front portion to the back portion of the body.

6. The artificial nail tip of claim 5, wherein the body is of molded plastic construction.

* * * * *